United States Patent [19]

Encontre

[11] Patent Number: 4,662,591

[45] Date of Patent: May 5, 1987

[54] TABLE LEG MOUNT

[76] Inventor: Yves Encontre, 149 Wooster St., New York, N.Y. 10012

[21] Appl. No.: 689,314

[22] Filed: Jan. 7, 1985

[51] Int. Cl.[4] ..... F16B 12/30

[52] U.S. Cl. ..... 248/188; 248/205.3; 403/227; 403/104; 108/158

[58] Field of Search ..... 248/188, 188.4, 188.9, 248/650, 205.3; 403/227, 249, 104; 108/158, 157

[56] References Cited

U.S. PATENT DOCUMENTS

| | | | |
|---|---|---|---|
| 239,556 | 3/1881 | Sabin | 248/188.4 |
| 1,849,835 | 3/1932 | Jantzen et al. | 248/188.9 |
| 2,272,848 | 2/1942 | Miller | 248/188.4 X |
| 2,456,480 | 12/1948 | Austin | 403/227 X |
| 2,809,876 | 10/1957 | Huff | 248/188 |
| 2,904,379 | 9/1959 | Nelson | 248/188 |
| 3,572,511 | 3/1971 | Triplett | 211/105.6 |

FOREIGN PATENT DOCUMENTS

| | | | |
|---|---|---|---|
| 1345105 | 10/1963 | France | 248/188 |
| 1539052 | 1/1979 | United Kingdom | 248/205.3 |

*Primary Examiner*—Ramon S. Britts
*Assistant Examiner*—Karen J. Chotkowski
*Attorney, Agent, or Firm*—Thomas R. Morrison

[57] ABSTRACT

A table leg mount for attaching a table leg to a table top includes a mounting member which has an integrally formed screw shank. The mounting member is attached to the table top by a mounting plate and projects into a hollow portion on the upper end of the table leg. The screw shank passes through a hole in a resilient gripping member and engages a threaded portion on the table leg. Tightening the table leg onto the mounting member forces the gripping member to bear against a conical portion on the mounting member and to also bear against the inside of the hollow portion of the table leg thereby creating a rigid connection between the table leg, the mounting member and the table top.

12 Claims, 10 Drawing Figures

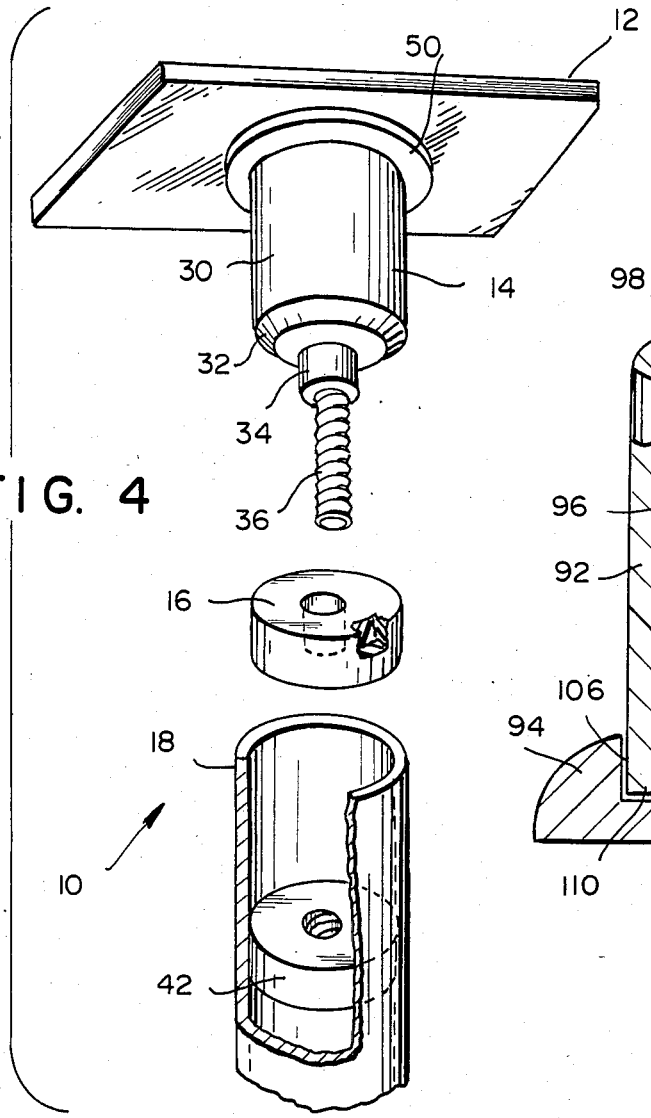
FIG. 4
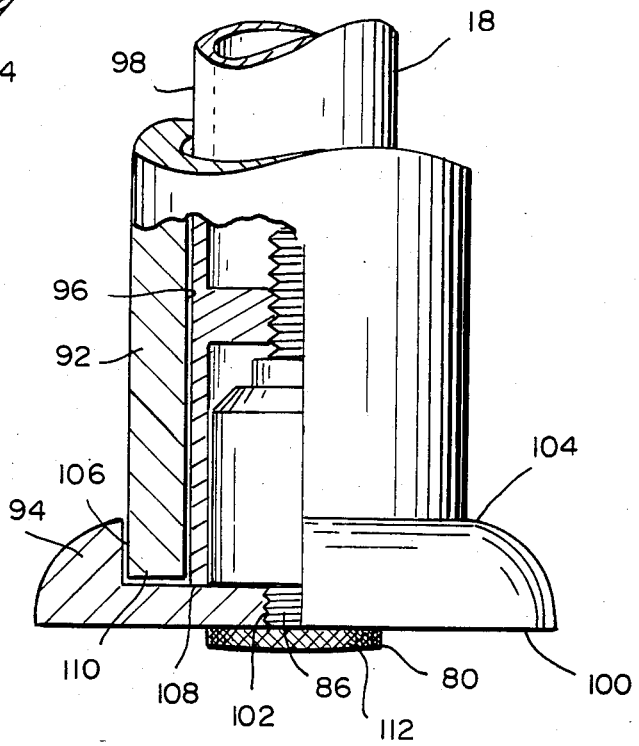
FIG. 5
FIG. 6a
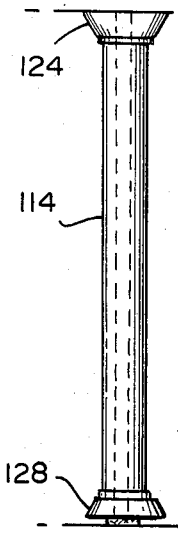
FIG. 6b
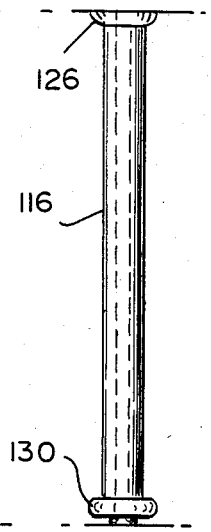
FIG. 6c
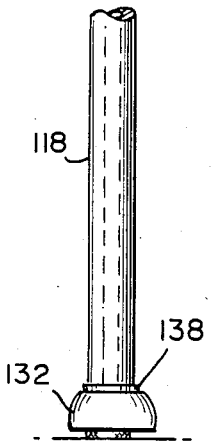
FIG. 6d
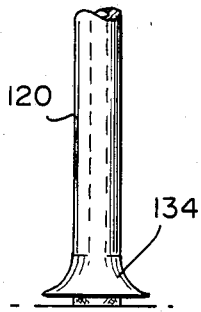
FIG. 6e
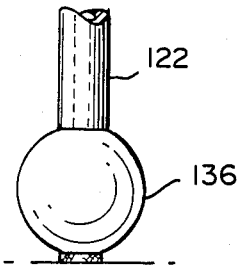

TABLE LEG MOUNT

BACKGROUND OF THE INVENTION

The present invention relates to novel and improved means for mounting support legs upon tables, desks and similar articles of furniture, and in particular to a mounting assembly by means of which the legs may be secured to the table rigidly and immovably without the use of tools.

The mounting of table legs has presented the inherent problem of securing the legs to the table in such a manner that the legs will not loosen or wobble during use over extended periods of time. While rigid mounts have been devised in the industrial field, such mounts are not practical for use with furniture since they detract from the decorative and aesthetic appearance thereof.

The prior art related to furniture include numerous examples of apparatus for the mounting of legs to the underside of table members or to adjacent assemblies. Included in the prior art are the devices shown in the following U.S. Pat. Nos.:

U.S. Pat. No. 1,638,561 issued to Busch, et.al., U.S. Pat. No. 2,544,504 issued to Keys, U.S. Pat. No. 3,603,546 issued to Ruffert, and U.S. Pat. No. 3,488,697 issued to Lewandowski all show legs which are attachable to furniture or other articles by screw means. None of these patents, however show elastomeric or compressible members which grip and retain the mounted legs securely against movement and loosening.

U.S. Pat. No. 3,259,431 issued to Gale, U.S. Pat. No. 3,452,953 issued to Bonnamy, U.S. Pat. No. 3,572,511 issued to Triplett, and U.S. Pat. No. 3,848,701 issued to Hughes all show leg mounts which include compressible or defromable rings, sleeves or gaskets which are used in an attempt to retain the legs immovably. These devices, however, either require a specialized support structure such as a socket built into the artice to be supported, or require unsightly mounting components which would not be suitable for use with decorative furniture.

Each of the devices shown in the above patents suffers from one or more of the following deficiencies: Either the devices do not utilize a compressible member which subjects the legs to the possibility of loosening over the course of time or where a compressible member is used, the device requires a tool and access for the tools above the legs as in the device of U.S. Pat. No. 3,848,701. None of the devices found in the prior art include means for guiding and retaining the leg to ensure a rigid and reliable connection.

It is an object of this present invention to provide a table leg mount which utilizes a compressible member to form a rigid connection between a table top and a leg member.

Another object of the present invention is to provide a table leg mount which may be assembled to the underside of a table without the need for access to the top of the table.

Another object of the present invention is to provide a table leg mount for a hollow table leg with the operating members concealed within the hollow leg, thereby providing a smooth and decorative outward appearance.

Another object of the present invention is to provide a table leg mount which can be used with a variety of cover members or sleeves to form a variety of table leg styles.

Another object of the present invention is to provide a table leg mount which can be used to attach an adjustable glide to a table leg.

Still another object of the present invention is to provide a table leg mount which comprises a relatively small number of component parts which are economical of manufacture, resulting in a relatively low overall cost.

SUMMARY OF THE INVENTION

In order to overcome the limitations of the prior art, there is provided, in accordance with the present invention, a table leg mount assembly which features the use of a resilient gripping member. The table leg assembly includes a mounting member which has an integrally formed screw shank. The mounting member is secured to a mounting plate which may be attached to a table surface by means of screws or by means of an adhesive layer. The mounting member projects into a hollow portion which is formed on the upper end of the table leg and which contains the gripping member. The mounting member passes through a hole in the resilient gripping member and engages a threaded portion on the table leg. Tightening the table leg onto the mounting member compresses the gripping member, forcing it to bear against a conical portion on the mounting member and to also bear against the inside of the hollow portion of the table leg, thereby creating a rigid connection between the table leg, the mounting member and the table top.

In the primary embodiment, the table leg comprises a hollow cylinder, the upper portion of which includes an insert having a threaded hole which accepts the screw shank. In order to vary the appearance of the table leg to suit a variety of furniture styles, a hollow table leg cover or sleeve is provided which fits over the table leg. A top cap and a bottom cap are also provided which fit over the top and bottom ends of the table leg, respectively, for the purpose of complementing the appearance of the table leg cover. A glide member is adjustably mounted on the lower end of the table leg to prevent marring of the floor on which the table leg rests.

Additional objects and advantages of the invention will become apparent during the course of the following specification when taken in connection with the accompanying drawings in which:

BRIEF DESCRIPTION OF THE DRAWINGS

FIG. 4 is an exploded view of the apparatus of FIG. 1;

FIG. 5 is a fragmentary view of the lower portion of a table leg showing an adjustable glide member and the use of a hollow wooden cover member to modify the appearance of the table leg; and FIGS. 6*a* through 6*e* show a variety of hollow cover members which are used with the apparatus of FIG. 1 to provide a variety of furniture styles and surface finishes.

DESCRIPTION OF THE PREFERRED EMBODIMENTS

Figure 2:
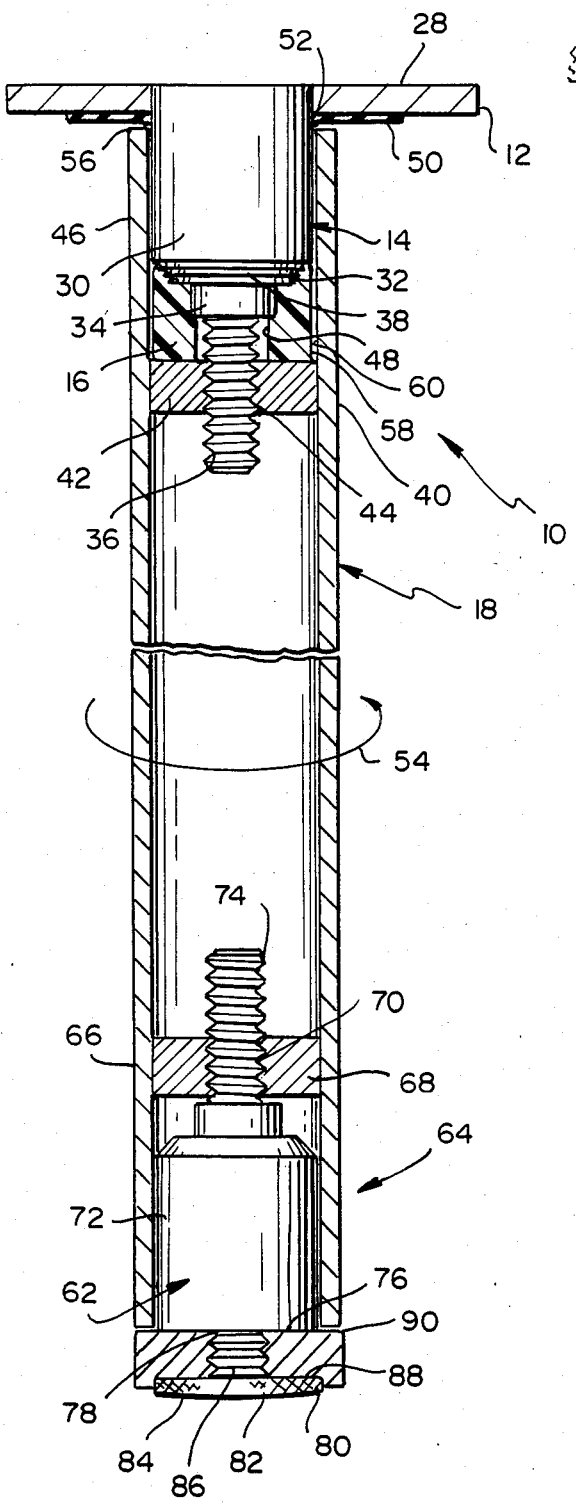
FIG. 2 is a cross-sectional view taken along the line 2—2 of FIG. 1 with the apparatus shown in the assembled state but prior to tightening the table leg.
Figure 1:
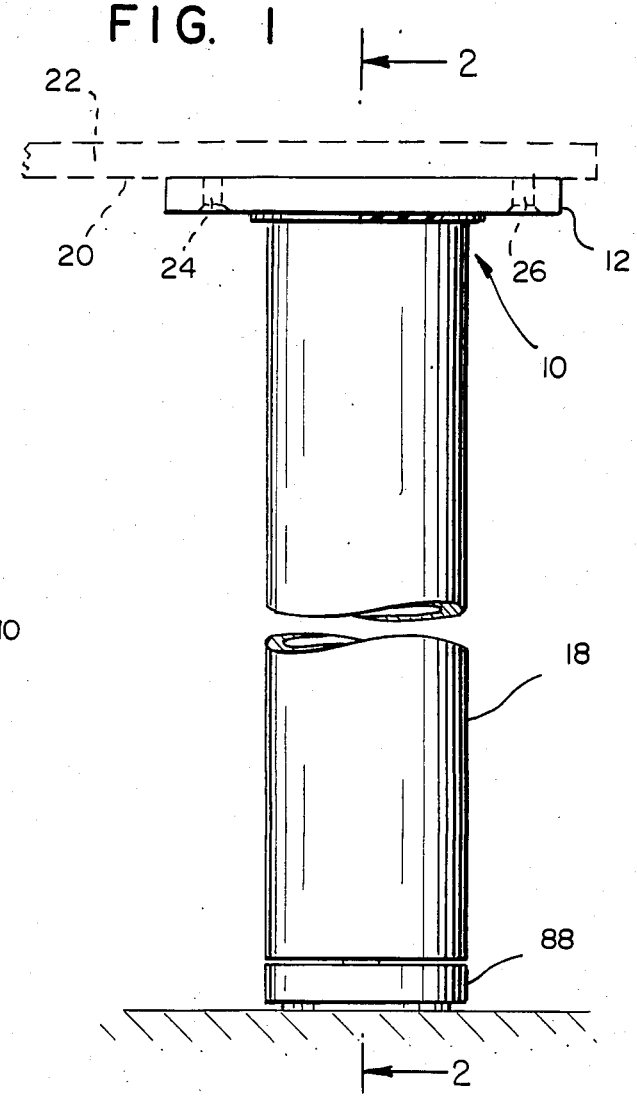
FIG. 1 is an elevation view of a table leg, made in accordance with the present invention, with the apparatus shown attached to a table top.

Referring in detail to the drawings, there is shown in FIGS. 1 and 2 a table leg assembly 10, made in accordance with the present invention and comprising a mounting plate 12, a mounting member 14, a gripping member 16 and a table leg 18. The mounting plate 12 is a metal plate which is secured to one corner of the under surface 20 of a table top 22, which is shown in broken lines in FIG. 1. The mounting plate 12 is attached to the table top 22 in a conventional manner either by screws which pass through the holes 24, 26, or by an adhesive layer which is spread on the upper surface 28 of the mounting plate.

Figure 3:
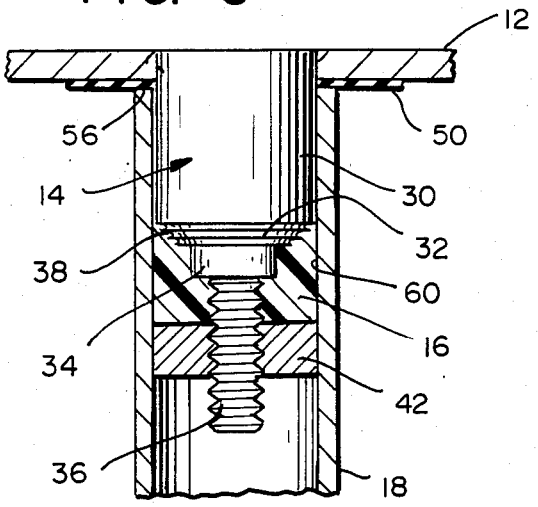
FIG. 3 is a fragmentary cross-sectional view similar to FIG. 2 with the leg shown after it has been tightened.

As is best shown in FIGS. 2 and 3, the mounting member 14 depends centrally from the mounting plate 12 and is rigidly secured thereto by welding or other conventional means. The mounting member 14 is in the form of a solid metal cylinder 30 having a tapered end portion 32. Projecting from this tapered end portion 32 is an integrally formed smaller cylinder 34 which carries a threaded screw shank 36.

In the preferred embodiment shown in FIG. 2, the tapered end portion 32 has a plurality of circumferential grooves or serrations 38, the function of which will be presently described.

The table leg 18 is a hollow metal cylinder, within the upper portion 40 of which a relatively thick circular metal disk 42 is rigidly secured, as by welding. The disk 42 has a threaded central hole 44 which is sized to receive the threaded shank 36. The table leg 18 is sized so that its upper end 46 fits slideably and snugly onto the cylinder 30 of the mounting member 14.

The gripping member 16 is best shown in FIG. 4 and comprises a thick cylindrical ring which is made of a relatively hard rubber and has an outer diameter which is sized to enable it to fit loosely within the hollow table leg 18. The gripping member 16 is provided with a central hole 48 which is sized to receive the cylindrical portion 34 which carries the screw shank.

The apparatus 10 also includes a relatively thin circular rubber pad 50 which has a central hole 52 sized to receive the cylinder 30.

In use, the cylindrical gripping member 16 is inserted into the top open end 46 of the table leg 18 so that it rests on the metal disk 42. The table leg 18 is then brought to the mounting member 14, which has been previously attached to the table top 22, with the screw shank 36 extending through the hole 48 in the gripping member 16 and into the threaded hole 44 of the disk 42. The table leg 18 is now rotated in the direction shown by the arrow 54 in FIG. 2 so that the screw shank 36 screws into the disk 42. As is shown in FIG. 2, the cylinder 30 of the mounting member 14 fits slidably into the upper end 46 of the table leg 18, and the lower cylindrical portion 34 extends into the central opening 48 of the gripping member 16. FIG. 2 shows the table leg 18 before it has been turned to its final secure position, with the upper edge 56 of the table leg still spaced a short distance below the rubber pad 50. The gripping member 16 is performing no function at this time and its outer surface 58 is slightly spaced from the inner surface 60 of the table leg 18.

Continued rotation of the table leg 18 brings it to its secured position which is shown in FIG. 3. This raises the disk 42 further onto the screw shank 36 so that it compresses the gripping member 16 against the tapered portion 32 of the cylinder 30. Sufficient force is applied in this manner to cause the gripping member 16 to be highly compressed and this compression causes it to expand in diameter so that it tightly grips the inner surface 60 of the table leg 18 as well as the tapered portion 32 of the cylinder 30 and the smaller cylinder 34, as is shown in FIG. 3. The grooves 38 which are formed in the tapered portion 32 create local areas of relatively high stress within the gripping member 16, thus aiding the tapered end portion 32 in engaging and slightly penetrating the gripping member and forcing the gripping member to expand laterally. At the same time, the top edge 56 of the table leg 18 has moved into firm abutment with the pad 50 and the mounting plate 12. The table leg assembly 10 thus provides a very rigid connection between the table leg 18 and the tabletop 22. The abutment of the top of the table leg 18 against the pad 50 and the mounting plate 12, combined with the pressure of the gripping member 16 against the inner surface 60 of the table leg 18 and against the mounting member 14, results in the creation of an extremely rigid table leg joint.

FIG. 2 also shows the use of an alternative form of mounting member 62 to provide an adjustable glide assembly 64 for the table leg 18. Within the lower portion 66 of the table leg 18, there is welded a relatively thick circular metal disk 68 having a threaded central hole 70, and being similar to the disk 42. The mounting member 62 which is provided, is generally similar to the mounting member 14 and includes a cylindrical portion 72 and a screw shank 74. The screw shank 74 is threaded into the threaded hole 70. The bottom portion 76 of the mounting member 62 is formed with a central threaded hole 78 for mounting a glide member 80. This glide member 80 includes a base 82 having a slightly convex bottom surface 84, and a threaded stud 86 projecting from an upper surface 88. The threaded stud 86 passes through the central aperture of a disk 90 and is inserted into the threaded hole 78. The disk 90 has approximately the same outer diameter as the table leg 18. The height of the table relative to a floor may be varied by rotating the cylinder 72 and its screw shank 74 relative to the table leg 18 and its rigid disk 68.

FIG. 5 shows the use of the glide assembly 64 in combination with a hollow wooden cylindrical cover member or sleeve 92 and a metal bottom cap 94 which are provided in order to modify the appearance of the table leg 18 and to create a desired decorative effect. The cylindrical cover member 92 has an inner bore 96 which fits over the outer surface 98 of the table leg 18. The bottom cap 94 includes a flat lower surface 100 and a convex upper surface 104. The lower surface 100 has a central hole 102 through which passes the threaded stud 86 of the glide member 80. The upper surface 104 includes a central counterbored portion 106 into which the end 108 of the table leg 18 and the end 110 of the cover member 92 project. The glide member 80 has a knurled surface 112 which facilitates rotation of the glide member and adjustment of the table surface 22.

FIGS. 6*a* through 6*e* show alternative top caps and bottom caps which are used with table leg covers 114, 116, 118, 120 and 122, table leg assemblies 10 and glide assemblies 62 which have been previously described, in order to vary the outer appearance of the table leg 18. The top caps 124, 126 and the bottom caps 128, 130, 132, 134 and 136 are each generally similar in construction to the bottom cap 94 in that they include a central bore into which an end of the table leg cover and the table leg project in the manner shown in FIG. 5. The outer surfaces of the top caps 124, 126 and bottom caps 128, 130, 132, 134 and 136 vary as is shown in FIGS. 6*a* through 6*e* and include a conical configuration 124, 128 (FIG. 6*a*), a toroidal configuration 130 and a convex configuration 126 (FIG. 6*b*), a convex configuration 132 having a cylindrical end 138 (FIG. 6*c*), a concave configuration 134 (FIG. 6*d*), and a spherical configuration 136 (FIG. 6*e*). It is understood that the configurations shown are by way of example only and that a variety of top and bottom cap configurations and combinations thereof may be used with the table leg assembly according to the present invention. The table leg covers 114, 116, 118, 120 and 122, when mounted, have the outward appearance of table legs, and are made of selected materials, colors and surface finishes to match those of the table on which they are mounted.

While preferred embodiments of the invention have been shown and described herein, it is obvious that numerous additions, changes and omissions may be made in such embodiments without departing from the spirit and scope of the invention.

What is claimed is:

1. A leg mount assembly for mounting at least one support leg on an article of furniture, said assembly comprising:

a mounting member having a screw shank projecting from one end thereof, attachment means secured to said mounting member for attaching said mounting member to an under surface of said article of furniture, with said mounting member depending from said under surface and said screw shank extending downwardly, said mounting member having a lower surface, said leg having an upper hollow portion and an internally-threaded member secured within said hollow portion, said internally-threaded member having an upper surface facing said lower surface said mounting member being sized to fit loosely and turnably within said hollow portion with said screw shank sized and located to extend into said internally-threaded member, said support leg being being adapted to be mounted on said mounting member with said mounting member received within said hollow portion and said screw shank extending into said internally-threaded member, whereby said leg is selectively moved toward the under surface of said article of furniture by rotation of said leg and its internally-threaded member relative to said screw shank, a resilient gripping member sized for insertion within said hollow portion to a mounted position in which it rests between said upper surface of said internally-threaded member and said lower surface of said mounting member, said gripping member having a hole through which said screw shank passes in the mounted position of said gripping member, said gripping member being compressed axially between said lower surface and said upper surface by movement of said leg toward said mounting member, whereby said gripping member is expanded radially, said gripping member being of sufficient size and of sufficient resilience to bear against an inner surface of said support leg and against an outer surface of said mounting member when said gripping member is comprisses axially by movement of said leg upon said screw shank, thereby resulting in a rigid connection between said support leg and said mounting member.

2. A leg mount assembly according to claim 1 in which said resilient gripping member comprises a cylindrical member having a central aperture.

3. A leg mount assembly according to claim 1 in which said resilient gripping member is made of rubber.

4. A leg mount assembly according to claim 1 in which said support leg is hollow.

5. A leg mount assembly according to claim 1 in which said support leg comprises a hollow cylinder with said internally threaded portion centrally disposed in a disc member which is secured within an upper portion of said support leg.

6. A leg mount assembly according to claim 1 in which said lower surface of said mounting member includes a conical portion disposed adjacent to said screw shank.

7. A leg mount assembly according to claim 6 in which said conical portion includes a plurality of grooves.

8. A leg mount assembly according to claim 1 in which said attachment means comprises a mounting plate attached to said mounting member.

9. A leg mount assembly according to claim 8 in which said mounting plate includes a plurality of screw-receiving holes for attachment to a table top.

10. A leg mount assembly according to claim 8 in which said mounting plate includes an adhesive layer for attachment to a table top.

11. A leg mount assembly according to claim 1 further comprising a second mounting member adjustably mounted on a lower portion of said support leg and a glide member mounted on a lower portion of said second mounting member.

12. A leg mount assembly according to claim 11 which further comprises a bottom cap member of larger diameter than said support leg and mounted on the bottom end of said support leg by said glide member, said bottom cap member having a diameter larger than the diameter of said support leg, and an elongated hollow leg cover member extending between said bottom cap member and the under surface of said article of furniture and covering over said support leg.

* * * * *